United States Patent [19]

Wood

[11] Patent Number: 4,832,257

[45] Date of Patent: May 23, 1989

[54] CORNER STRUCTURE AND BLANK FOR A TRAY

[75] Inventor: Prentice J. Wood, Hapeville, Ga.

[73] Assignee: The Mead Corporation, Dayton, Ohio

[21] Appl. No.: 186,885

[22] Filed: Apr. 27, 1988

[51] Int. Cl.[4] ..... B65D 5/24

[52] U.S. Cl. ..... 229/186; 206/427; 229/40

[58] Field of Search ..... 229/40, 112, 113, 114, 229/186, 189, 906, 41 B; 206/427

[56] References Cited

U.S. PATENT DOCUMENTS

| | | | |
|---|---|---|---|
| 742,159 | 10/1903 | Burton | 229/186 |
| 1,148,219 | 7/1915 | Cornell | 229/41 B |
| 1,423,001 | 7/1922 | Maxwell | 229/189 |
| 1,498,375 | 6/1924 | Helfrich | 229/186 |
| 3,454,209 | 7/1969 | Persson | 229/186 |
| 3,976,241 | 8/1976 | Bemiss | 229/186 |
| 4,128,169 | 12/1978 | Arneson | 229/40 |
| 4,451,001 | 5/1984 | Webinger | 229/186 |
| 4,582,199 | 4/1986 | Schuster | 229/40 |

*Primary Examiner*—Gary Elkins

*Attorney, Agent, or Firm*—Rodgers & Rodgers

[57] ABSTRACT

A tray formed from paperboard includes a quadrilateral main panel having right angle corners, a pair of end panels foldably joined respectively to opposite end edges of the main panel, a pair of side panels foldably joined respectively to opposite side edges of the main panel, a major web panel foldably joined to each end edge of each of said end panels, a minor web panel foldably joined to each end edge of each side panel, each major and each minor web panel being foldably joined to each other at each corner of the main panel along a common fold line, each major web panel having a major angle of approximately fifty-seven degrees defined by the common fold line and by the adjacent end edge of the associated end panel and each minor web panel having a minor angle defined by its common fold line and by the adjacent end edge of the associated side panel, the side and end panels being approximately perpendicular to the main panel and the major and minor web panels being disposed in the flat face contacting relation to each other, and adhesive means securing a part of each major web panel to the end of the associated side panel so as to secure the associated minor web panel therebetween.

10 Claims, 2 Drawing Sheets

CORNER STRUCTURE AND BLANK FOR A TRAY

TECHNICAL FIELD

This invention relates to trays formed of paperboard and which are used in shipping, handling and display of secondary packages in which a plurality of primary packages are disposed.

BACKGROUND ART

U.S. patent application Ser. No. 102,353 filed Sept. 29, 1987, now U.S. Pat. No. 4,747,487 issued 5/31/88 and owned by the owner of this invention discloses an end loaded carton having a web panel at each bottom corner of the carton for insuring tightness of the carton about a group of articles packaged therein. This carton is formed from a blank of the wrap-around type.

U.S. Pat. No. 4,558,816 issued Dec. 17, 1985 and owned by the assignee of this invention discloses a secondary container in which a plurality of primary packages are disposed for shipment and display at points of purchase.

SUMMARY

According to this invention, a shipping tray preferably is formed of paperboard and is used to transport, warehouse and display at points of purchase a plurality of secondary packages such as those disclosed in the above mentioned U.S. Pat. No. 4,558,816.

According to this invention in one form, a tray is provided comprising a quadrilateral main panel having right angle corners together with pairs of side and end panels foldably joined respectively to opposite side and end edges of said main panel, a major web panel foldably joined to each end edge of each of the end panels, a minor web panel foldably joined to each end edge of each of said side panels, each of said major and of said minor web panels being foldably joined to each other at each corner of the main panel along a common fold line which extends outwardly from each corner of the main panel, each major web panel having a major angle defined by the associated common fold line and by the adjacent end edge of the adjacent end panel, the minor web panel at each corner of the tray having a minor angle defined by the associated common fold line and by the adjacent end edge of the associated side wall, the side and end walls being disposed in perpendicular relation to the main panel and the major and minor web panels at each corner of the tray being disposed in flat face contacting relation to each other and with the minor web panels interposed between the major web panels at each corner of the tray and the adjacent end of the associated side panel.

BEST MODE OF CARRYING OUT THE INVENTION

Figure 1:
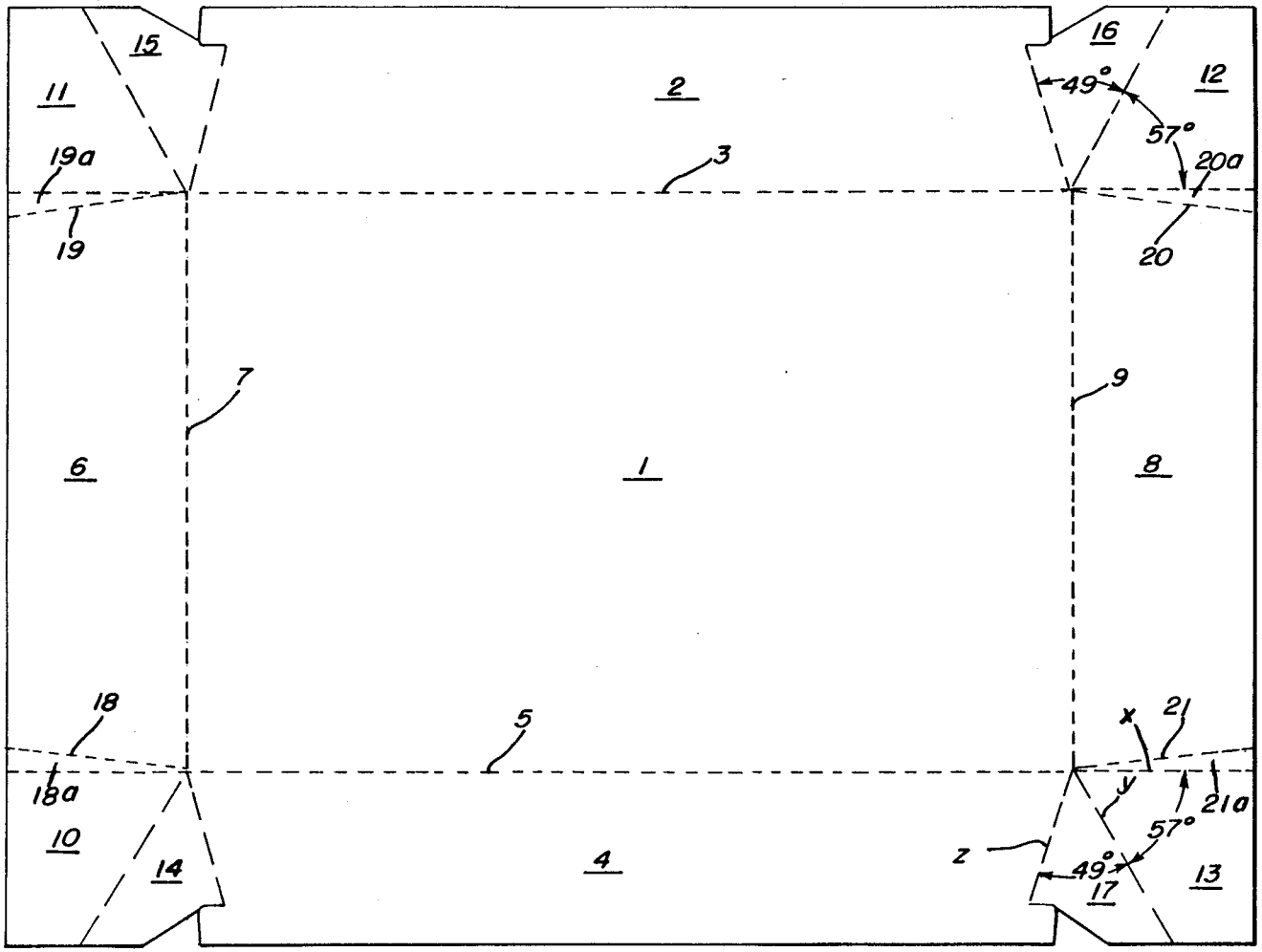
FIG. 1 is a plan view of a blank as viewed from the inside and from which a tray is formed according to this invention.

With reference to FIG. 1 the numeral 1 designates a main panel of quadrilateral configuration and having right angle corners. Side panel 2 is foldably joined to main panel 1 along a fold line 3. Similarly side panel 4 is foldably joined to main panel 1 along a fold line 5. End panel 6 is foldably joined to main panel 1 along fold line 7 and end panel 8 is foldably joined to main panel 1 along fold line 9. From FIG. 1 it is apparent that end panels 6 and 8 are of rectangular configuration.

Web structures at each corner of main panel 1 are identical. These web structures include major web panels 10, 11, 12 and 13. Each web structure also includes a minor web panel such as 14, 15, 16 and 17.

Since all of the corner structures are identical only the corner structure comprising major web panel 13 and minor web panel 17 is here described in detail.

As is apparent from FIG. 1 major web panel 13 is foldably joined to the adjacent end edge X of end panel 8 while minor web panel 17 is foldably joined to the adjacent end of side panel 4 along fold line Z. The web panels 13 and 17 are foldably joined to each other along a common fold line Y.

Figure 2:
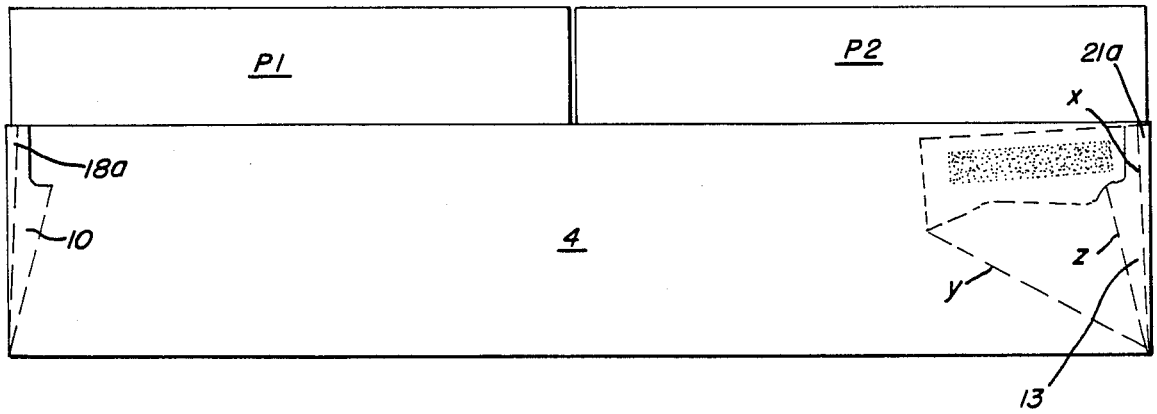
FIG. 2 is a side view of a tray formed from the blank of FIG. 1 and which includes a pair of secondary packages disposed within the tray.

It is vital that trays formed according to this invention effectively grip secondary packages such as P1 and P2 as shown in FIG. 2. It is vital therefore that the angular relationships taught by this invention be utilized. For example, the angular relation between fold line X and the common fold line Y is preferably approximately fifty-seven degrees and the angle between fold line Z and common fold line Y is approximately forty-nine degrees. These angular relationship insure snug gripping of the primary packages such as P1 and P2.

Where primary packages include corners which are slightly bevelled, it is desirable to incorporate crease lines such are designated by the numerals 18, 19 and 20 and 21.

Figure 3:
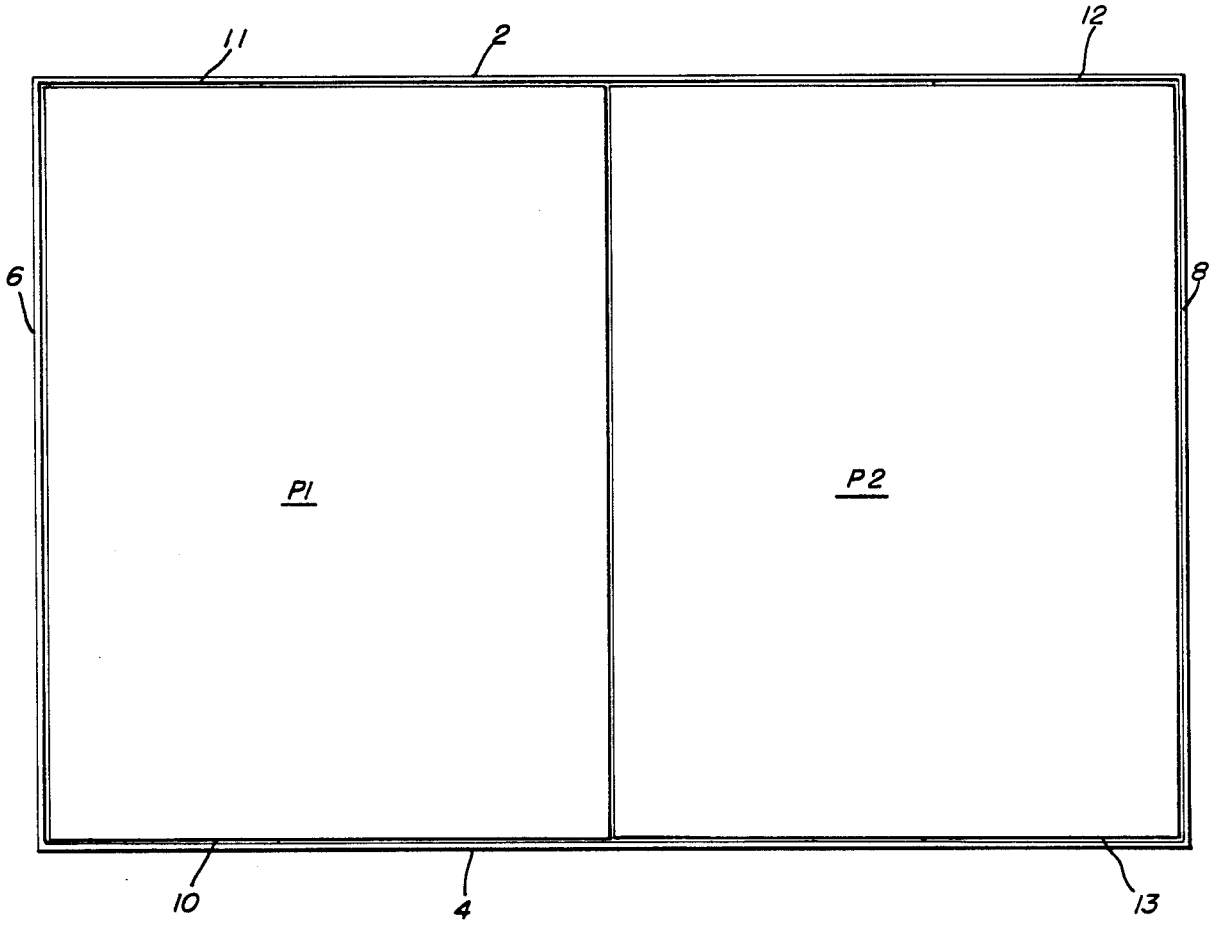
FIG. 3 is a top view of the arrangement shown in FIG. 2.

In order to form the set-up and loaded tray as shown in FIGS. 2 and 3, a blank such as FIG. 1 is fed into position and packages such as P1 and P2 are deposited atop main panel 1. Thereafter web structures at the corners of the blank are pushed upwardly causing initial folding along common fold lines such as Y and elevation of the end panels 6 and 8. Continued manipulation of the web structures causes complete collapse thereof so that each minor web panel is interposed between the adjacent end of the associated side wall and its associated major web panel. The structure is maintained in this position by means of adhesive indicated by stippling in FIG. 2 which is applied either to the outer surface of major web panel such as 13 or to the inner corner of side wall such as 4. Of course similar activity occurs at all corners of the tray. The triangular bevelled panels in FIG. 2 are indicated by numerals **18*a* and 21*a* and are used where the secondary packages have bevelled corners. Where the secondary packages have square corners, the bevelled panels 18*a*, 19*a*, 20*a* and 21*a* are not used as shown in FIG. 3. An end view of FIG. 3 is not shown since such a view would simply show rectangular end panel such as 8 and the upper part of P2** which would be rectangular.

With the tray and its associated packages assembled as shown in FIGS. 2 and 3, transport and stacking of packages are greatly facilitated. Since the tray side and end panels and web structures tightly grip the associated packages P1 and P2, the whole assembly is rendered very stable and precludes toppling when stacked in tiers in a warehouse or at a point of purchase. Also the bottom main panel of each tray in upper tiers tends to protect the tops of secondary packages disposed in lower tiers. Since a tray formed according to this invention preferably is formed of kraft paperboard rather than of corrugated board, any tendency of corrugated board to collapse due to excessive moisture or undue strain is largely eliminated according to one feature of this invention.

I claim:

1. A unitary blank for forming a tray and comprising a quadrilateral main panel having right angle corners, a pair of rectangular end panels foldably joined along fold lines respectively to opposite end edges of said main panel, a pair of side panels foldably joined respectively to opposite side edges of said main panel, a major web panel foldably joined to each end edge of each of said end panels, a minor web panel foldably joined to each end edge of each of said side panels, each of said major and of said minor web panels being foldably joined to each other at each corner of said main panel along a common fold line which extends outwardly from each corner of said main panel, the major angle between each of said common fold lines and the adjacent end edge of the associated end panel being substantially greater than the minor angle between each of said common fold lines and the adjacent end edge of the associated side panel and the angle between the adjacent end edge of the associated side panel and the associated fold line joining the associated side panel with the main panel plus the angular difference between the major and minor web panels is slightly less than ninety degrees.

2. A unitary blank according to claim 1 wherein the sum of each of said major and of said minor angles exceeds ninety degrees.

3. A unitary blank according to claim 1 wherein each of said major angles is approximately fifty-seven degrees and wherein each of said minor angles is approximately forty-nine degrees.

4. A unitary blank according to claim 1 wherein a crease line is formed in each end of each of said end panels and extends from the adjacent corner of said main panel and defines an acute angle with the adjacent end edge of the associated end panel.

5. Corner structure for a tray formed from a unitary blank, said corner structure comprising a quadrilateral main panel with right angle corners, side and end panels foldably joined respectively to edges of said main panel along fold lines which intersect at a corner of said main panel, said side and said end panels having outer and inner surfaces and being substantially perpendicular to said main panel and said end panel being substantially rectangular, a major web panel having an outer surface and being foldably joined to an end edge of said end panel which is adjacent said corner, a minor web panel foldably joined to an end edge of said side panel which is adjacent said corner, said major and said minor web panels being foldably adjoined along a common fold line, said major web panel having a major angle defined by said common fold line and said end edge of said end panel and said minor web panel having a minor angle defined by said common fold line and by said end edge of said side panel, the sum of said major and said minor angles being greater than ninety degrees, said major and said minor web panels being disposed in flat face contacting relation with each other, and adhesive means securing a part of said major web panel to said side panel the angle between the adjacent end edge of the associated side panel and the associated fold line joining the associated side panel with the main panel plus the angular difference between the major and minor web panels is slightly less than ninety degrees.

6. Corner structure according to claim 5 wherein the outer surface of said part of said major web panel is secured to the inner surface of said side panel.

7. Corner structure according to claim 5 wherein said major agle is approximately fifty-seven degrees.

8. Corner structure according to claim 5 wherein said minor angle is approximately forty-nine degrees.

9. Corner structure according to claim 5 wherein a crease line is formed in said end panel and extends from said corner of said main panel at an acute angle to said end edge of said end panel.

10. Corner structure according to claim 5 wherein said minor web panel is interposed between said major web panel and the inner surface of said side panel.

* * * * *